US005746374A

United States Patent [19]

Simonetti et al.

[11] Patent Number: 5,746,374

[45] Date of Patent: May 5, 1998

[54] ROTARY SPRINKLER HAVING A TURRET ASSEMBLY

[75] Inventors: Sergio G. Simonetti, Westport, Conn.; Howard W. Andrews, Winchester, Va.

[73] Assignee: Melnor Inc., Winchester, Va.

[21] Appl. No.: 568,312

[22] Filed: Nov. 30, 1995

[51] Int. Cl.[6] ..... B05B 3/04

[52] U.S. Cl. ..... 239/240; 239/246; 239/391; 239/394

[58] Field of Search ..... 239/222.13, 222.21, 239/225.1, 240.2, 246, 247, 248, 263, 273, 279, 280, 394, 390–2, 505, 513; D23/214

[56] References Cited

U.S. PATENT DOCUMENTS

| | | | |
|---|---|---|---|
| Re. 32,386 | 3/1987 | Hunter | 239/240 |
| D. 239,174 | 3/1976 | Raffler et al. | D23/214 |
| D. 277,777 | 2/1985 | Lemkin | D23/214 |
| D. 305,791 | 1/1990 | Lang | D23/214 |
| D. 358,449 | 5/1995 | Ford | D23/214 |
| D. 374,914 | 10/1996 | Wang | D23/214 |
| D. 378,399 | 3/1997 | Simonetti et al. | D23/214 |
| 1,919,196 | 7/1933 | Brooks | 239/240 |
| 2,970,774 | 2/1961 | Li | 239/242 |
| 3,081,950 | 3/1963 | Rinkewich | 239/394 |
| 3,112,883 | 12/1963 | Blanchard | 239/394 |
| 3,464,628 | 9/1969 | Chow | 239/232 |
| 4,303,201 | 12/1981 | Elkins et al. | 239/391 |
| 4,347,981 | 9/1982 | Hayes | 239/394 |
| 4,534,512 | 8/1985 | Chow et al. | 239/394 |
| 4,903,897 | 2/1990 | Hayes | 239/394 |
| 5,048,757 | 9/1991 | Van Leeuwen | 239/241 |
| 5,526,982 | 6/1996 | McKenzie | 239/240 |

OTHER PUBLICATIONS

Author unknown; catalog entitled, "1994 Lawn and Garden Products," by Naan; date unknown but believed to be circa 1994; cover page and p. 2.

Author unknown; catalog entitled, "We Mean Green," by Gilmore Group; date unknown but believed to be circa 1995; cover page and page with handwritten #1.

Author unknown; catalog entitled, "1996 Product Catalog," by Gardena; date unknown but believed to be circa 1995; cover page and p. 7.

*Primary Examiner*—Andres Kashnikow
*Assistant Examiner*—Lisa Ann Douglas
*Attorney, Agent, or Firm*—Baker, Donelson, Bearman & Caldwell

[57] ABSTRACT

A rotary sprinkler is provided having a stationary base with a water inlet for attachment to a conventional garden hose and a main housing operatively mounted on the base for rotation about a vertical axis. A turret assembly comprising a turret housing is operatively mounted on the main housing for concomitant rotation therewith during operation. The turret housing has an outer surface, a generally cylindrical inner surface, and a tapered inner surface. A plurality of nozzle interface extensions are attached to the outer surface and extend radially outwardly therefrom on an axis generally perpendicular to the tapered inner surface. A plurality of outwardly extending ribs are also attached to the outer surface of the turret housing to facilitate the user rotating the turret housing relative the main housing. A plurality of nozzles are seated in the nozzle interface extensions. Water discharged from the nozzles is deflected by a deflector slidingly disposed on the turret housing. The sprinkler operates quietly and produces a spray of water that will not damage delicate flowers or plants.

50 Claims, 5 Drawing Sheets

FIG. 5
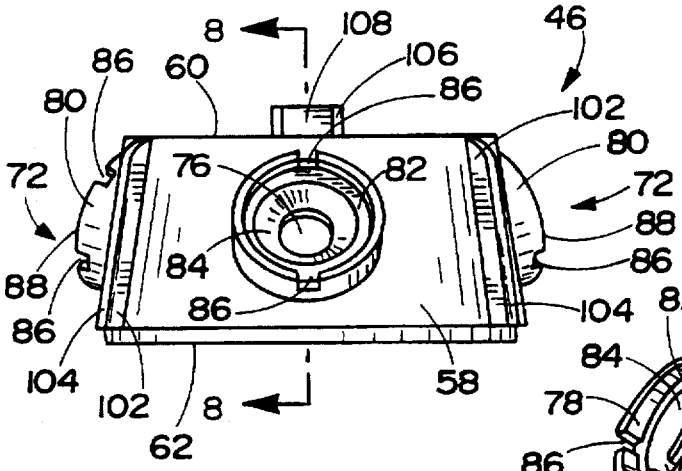
FIG. 7
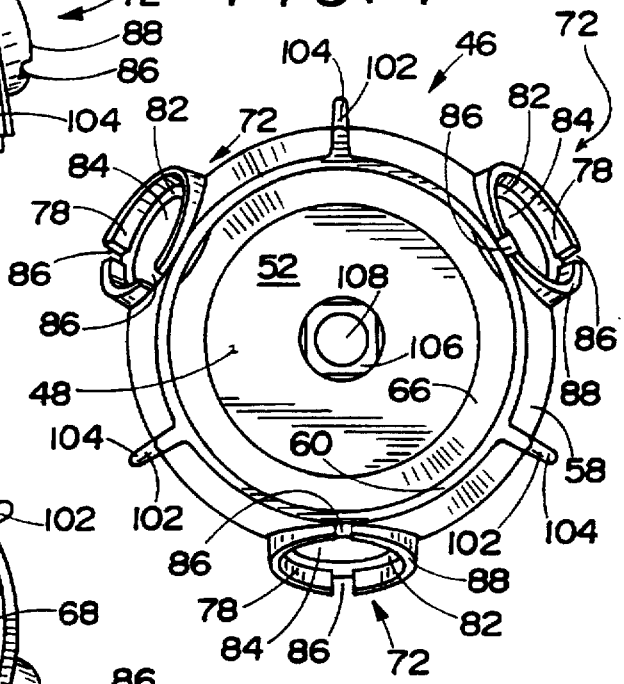
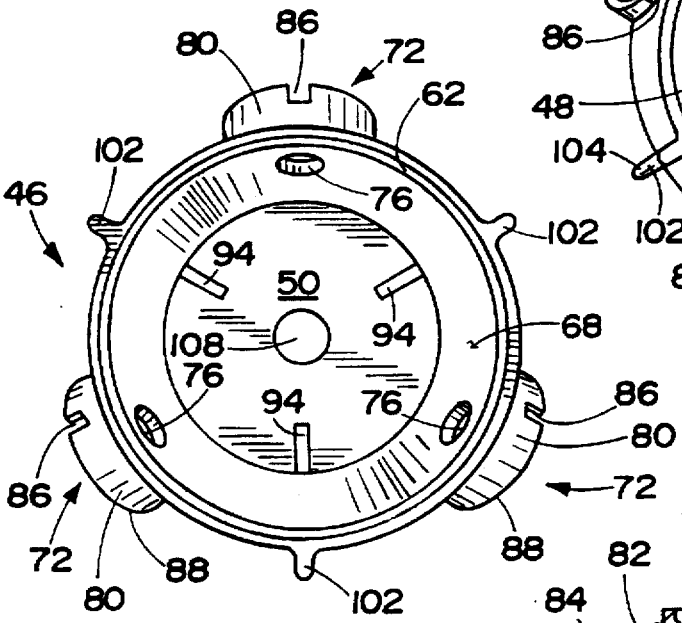
FIG. 6
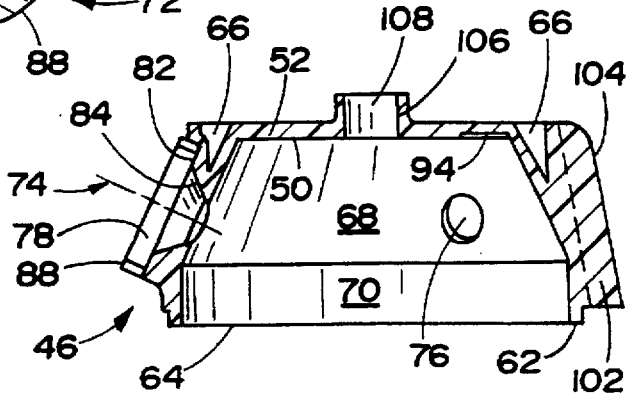
FIG. 8

ROTARY SPRINKLER HAVING A TURRET ASSEMBLY

BACKGROUND

Rotating sprinklers have been known in the art for a number of years. One type of rotating sprinkler is the step-by-step pulsating rotary sprinkler. These type sprinklers employ an impact arm for rotating movement about a vertical axis. The impact arm is disposed in a position to be engaged by the jet stream of water issuing from the outlet nozzle of the sprinkler. The resulting force from the water causes the impact arm to impact the rotatable sprinkler body so as to impart an arcuate movement to the sprinkler body. As a result, a relatively slow arcuate step-by-step movement is cyclically imparted to the sprinkler body. This type of sprinkler, however, suffers from three major disadvantages. First, the impact arm impacting the sprinkler body and jet stream of water during operation creates a substantially loud noise which is significantly annoying especially when the sprinkler is operated throughout the night-time hours when most people are trying to sleep. Second, the jet stream of water issuing from the sprinkler is discharged in a concentrated stream of water consisting of heavy droplets which can damage or kill delicate flowers or plants on impact. Third, such sprinklers do not provide a sufficient even distribution of water over a selected area of coverage due to the step-by-step movement of the sprinkler body and of the concentrated stream of water.

Another type of rotating sprinkler is a sprinkler that uses the water discharged from its nozzles to drive the body about a vertical axis. This type of sprinkler, however, also suffers from the second and third disadvantages listed above. Therefore, there is a need for a rotary sprinkler that can operate quietly and can evenly distribute water in a mist or small droplet form so as to not damage delicate flowers or plants.

SUMMARY

The present invention addresses the above needs by providing a rotary sprinkler having a turret assembly that operates quietly when compared to existing rotary or pulsating sprinklers and evenly distributes water in a mist or small droplet form so as not to damage delicate flowers or plants.

The rotary sprinkler includes a butterfly-type base having a water inlet for receiving a supply of water and a main housing operatively mounted on the base for rotation about a vertical axis. The main housing has a lower section with a generally arcuate outer surface, a mid section having a generally cylindrical outer surface, a tapered upper section tapering radially inwardly, and a top cover integrally attached to the tapered upper section wherein the mid and tapered upper sections define a turret seat. A hydraulically driven driving means which includes a water input tube in fluid communication with the supply of water is operatively contained within the main housing for rotatably driving the main housing about a vertical axis during operation. Once the supply of water has been utilized by the driving means, it exits the main housing through a water outlet defined in the tapered upper section. The top cover includes a radially extending raised portion in diametrically opposed relation to the water outlet.

The rotary sprinkler further includes a turret assembly which is comprised of a generally hollow turret housing mounted on the turret seat of the main housing for concomitant rotation therewith during operation of the sprinkler. The turret housing has a generally disk shaped top with interior and exterior surfaces and a side wall with inner and outer surfaces and upper and lower ends. The inner surface of the side wall includes a tapered inner portion tapering radially inwardly and a generally cylindrical inner portion. The outer surface of the side wall may taper radially inwardly from the lower end to the upper end defining a truncated cone or frustoconically shaped outer surface. In a preferred embodiment, the outer surface is arcuately shaped for continuing the arcuation of the arcuate outer surface of the lower section of the main housing. The lower end of the side wall defines an opening. An annular V-shaped groove is formed in the upper end of the side wall which separates the disk shaped top from the outer surface. The cylindrical and tapered inner surfaces are seated on the turret seat defined on the main housing of the rotary sprinkler.

The turret housing further includes a plurality of equally spaced nozzle interface extensions integrally formed on the outer surface of the side wall. The extensions extend radially outwardly from the outer surface of the side wall on an axis generally perpendicular to the tapered inner portion of the inner surface. Preferably, this axis is elevated at an angle of approximately twenty-five degrees relative a horizontally disposed plane. A plurality of nozzle ports are defined by the side wall and pass through the tapered inner portion of the inner surface for selectively providing fluid communication between one of the plurality of nozzle interface extensions and the water outlet in the main housing during operation. The ports are equal in number to the plurality of nozzle interface extensions and concentrically disposed in co-axial alignment relative thereto.

Structurally, the plurality of nozzle interface extensions are hollow generally cylindrical shells having interior and exterior surfaces. The interior surfaces include an annular ledge and a tapered portion which define a plurality of nozzle seats. In addition, each shell further defines at least one selectively positioned longitudinal slot extending from an end distal the outer surface of the turret housing to the annular ledge. As such, the turret assembly further includes a plurality of nozzles suitable for discharging a spray of water therethrough operatively seated on the plurality of nozzle seats. The nozzles are either ultrasonically welded or solvent bonded in place on the nozzle seats. Moreover, each nozzle has at least one finger portion selectively positioned on an outer periphery thereof for operative engagement with the selectively position longitudinal slot defined on a particular shell which determines the rotational orientation of the nozzle relative that particular cylindrical shell. In a preferred embodiment, the turret assembly will utilize three cylindrical shells spaced one-hundred twenty degrees apart on the turret housing and three nozzles selectively designed to produce a mist spray, a medium spray, and a large spray of water, respectively. In operation, the rotary sprinkler will produce an area of water coverage ranging from approximately ten to eighty feet in diameter depending on which nozzle is engaged by the user.

The interior surface of the top further defines a plurality of radially extending grooves positioned in diametrically opposed relation relative the plurality of nozzle ports for selective operative engagement with the radially extending raised portion on the top cover of the main housing. Before or during operation of the sprinkler, the turret housing is selectively rotated by a user on the main housing such that one of said plurality of radially extending grooves operatively engages the radially extending raised portion. The operative engagement of one of the grooves and the raised portion rotationally aligns one of the plurality of nozzle ports with the water outlet providing fluid communication therebetween during operation of the sprinkler. It further provides concomitant rotation between the turret housing and the main housing of the rotary sprinkler during operation. Hence, a user will rotate the turret housing to select a particular nozzle to be used, then will provide a supply of water to the sprinkler through a water hose wherein the main housing and turret housing will concomitantly rotate while issuing water therefrom in a particular pattern and distance.

The turret housing further includes a plurality of outwardly extending ribs equal in number to the plurality of cylindrical shells and attached to the outer surface of the side wall. The ribs allow a user to easily and selectively rotate the turret housing relative the main housing before and during operation of the rotary sprinkler. Preferably, the ribs extend radially outwardly from the outer surface of the side wall and vertically extend the height of the turret housing. Moreover, the ribs are positioned in diametrically opposed relation relative the plurality of cylindrical shells and each has an outer edge which tapers radially inwardly from the lower end of the side wall to the upper end.

The exterior of the top further includes a vertically disposed member having a generally square outer surface concentrically attached thereto for facilitating the securing of the turret housing to the main housing. The vertically disposed member defines a hole therethrough which extends through the top for receiving a generally cylindrical extended portion defined on the top cover of the main housing. Reception of the extended portion within the hole substantially aligns the turret housing and main housing on a common vertical axis.

The turret assembly further includes a deflector for deflecting the spray of water discharged from one of the plurality of nozzles. Deflection of the spray of water causes the water to be evenly distributed over an area of coverage. The deflector has a generally elongated flat portion slidingly mounted on the exterior surface of the top for sliding movement thereon and an upward extending portion disposed at one end thereof. The deflector is slidingly movable between an extended position and a retracted position wherein the extended position exposes the upward extending portion to the spray of water thereby deflecting the spray of water. The elongated flat portion further defines an elongated hole therethrough for receiving the vertically disposed member of the top wherein the vertically disposed member limits the sliding movement of the deflector to the extended position and the retracted position. Furthermore, the square outer surface provides concomitant rotation between the turret housing and deflector during operation of the sprinkler.

There has thus been outlined, rather broadly, the more important features of the present invention in order that the detailed description thereof that follows may be better understood, and that the present contribution to the art may be better appreciated. There are, of course, numerous other novel features of the present invention that will become apparent from a study of the drawings and the description and which will form the subject matter of the claims appended hereto.

Moreover, it is to be understood that the phraseology and terminology employed herein are for the purpose of description and should not be regarded as limiting. As such, those skilled in the art will appreciate that the conception, upon which this disclosure is based, may readily be utilized as a basis for the designing of other systems for carrying out the several purposes of the present invention. It is important, therefore, that the claims be regarded as including such equivalent systems insofar as they do not depart from the spirit and scope of the present invention.

BRIEF DESCRIPTION OF THE DRAWINGS

These and other features, aspects, and advantages of the present invention will become better understood with regard to the following description, appended claims, and accompanying drawings where:

FIG. 5 is a side elevational view of a turret housing of the representative rotary sprinkler embodying the features of the present invention;

FIG. 6 is a bottom view of the turret housing shown in FIG. 5;

FIG. 7 is a top view of the turret housing shown in FIG. 5; and

FIG. 8 is a side sectional view of the turret housing shown in FIG. 5.

DESCRIPTION

Figure 1:
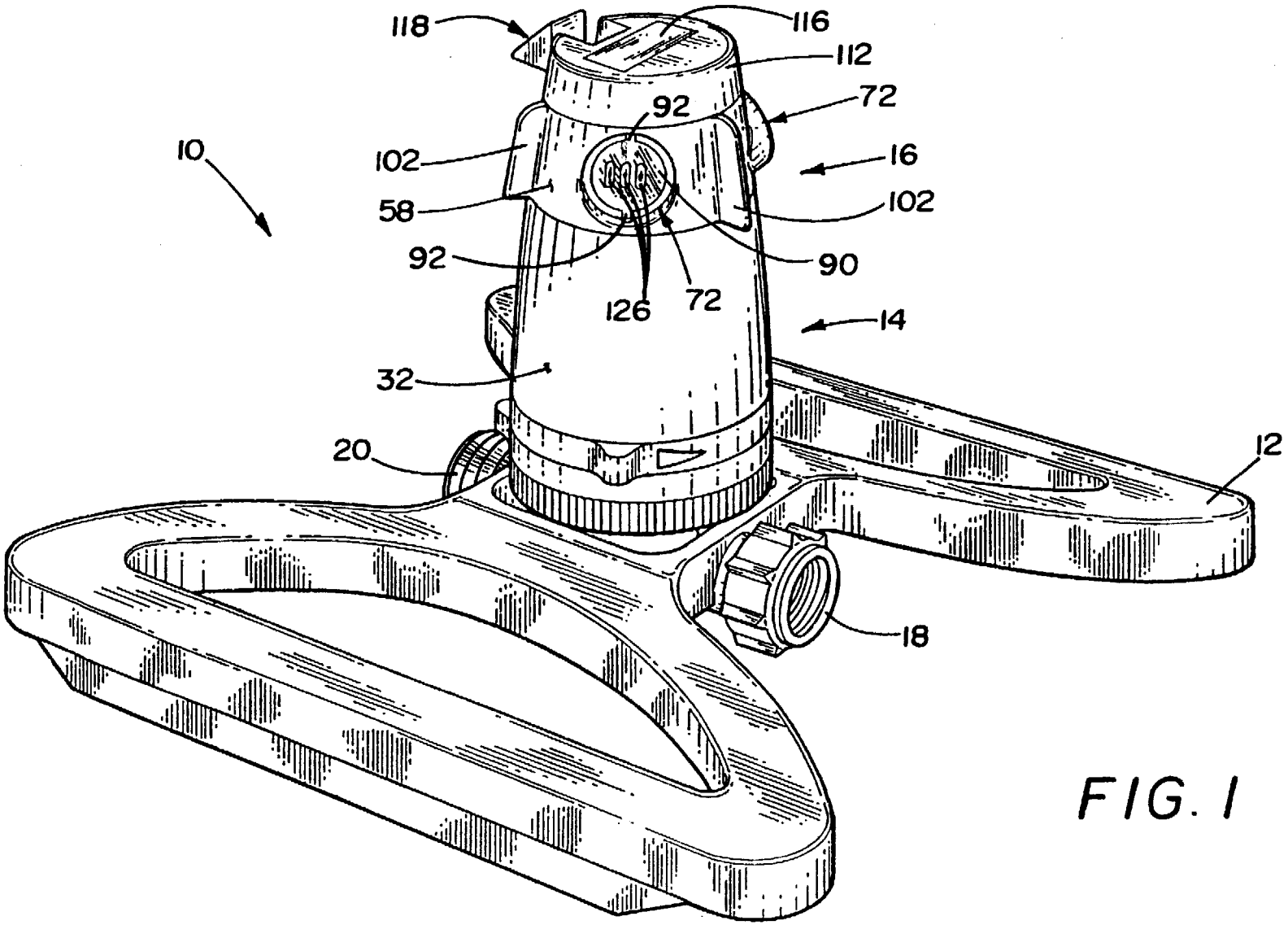
FIG. 1 is a perspective view of a representative rotary sprinkler embodying the features of the present invention.
Figure 2:
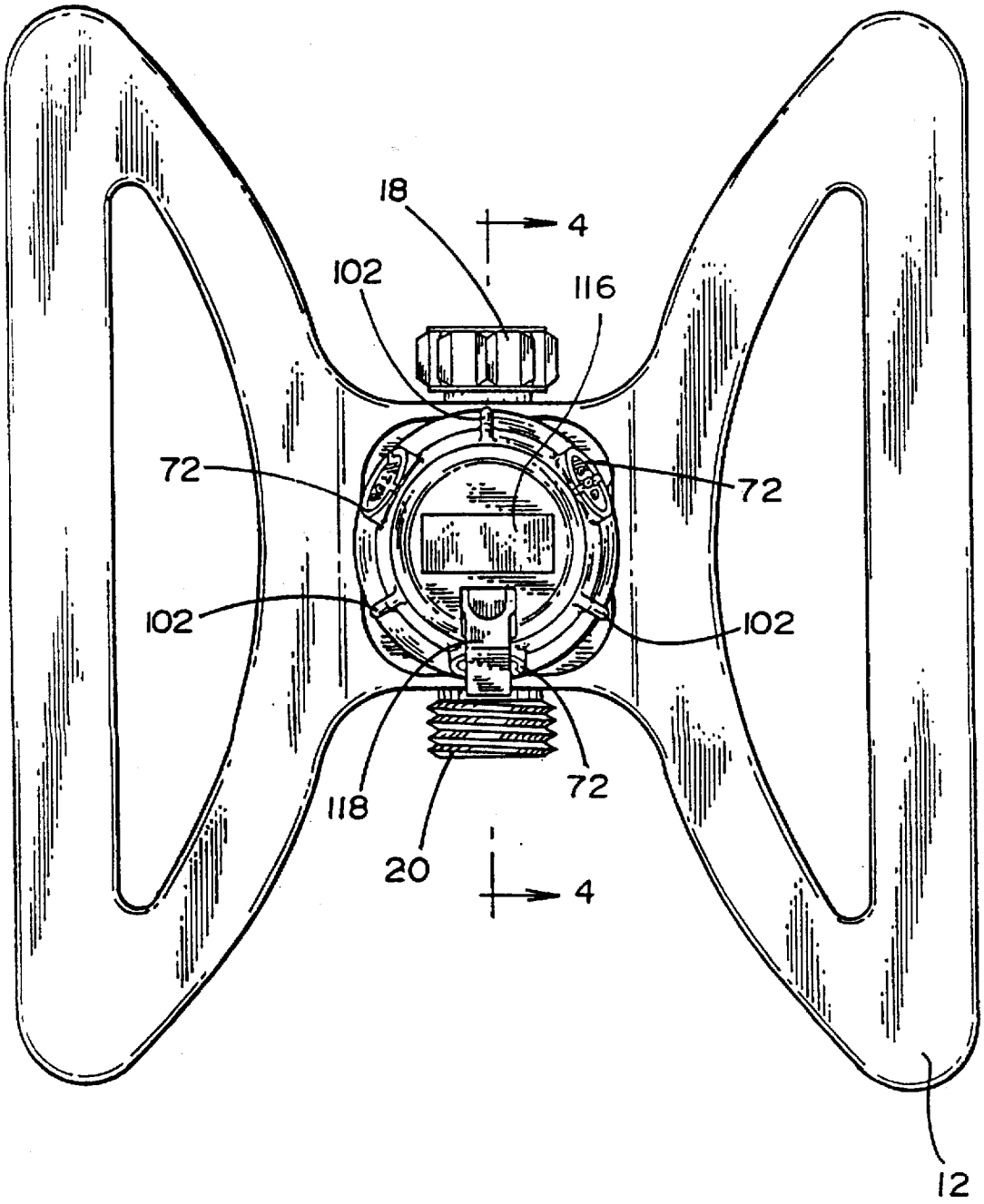
FIG. 2 is a top view of the representative rotary sprinkler embodying the features of the present invention.

Referring to the drawings for a clearer understanding of the present invention, FIG. 1 discloses generally at 10 a representative rotary sprinkler having a butterfly-type base 12, a generally hollow main housing 14, and a turret assembly 16. Base 12 includes a water inlet 18, having female threads formed therein for engagement with the male end of a conventional water hose (not shown), and a water outlet 20, having male threads formed thereon for engagement with the female end of a conventional water hose (not shown). The conventional water hose selectively provides a continuous supply of water to the water inlet 18. It will be understood that, during normal operation of the rotary sprinkler 10, water outlet 20 may be attached to another water hose or capped by a suitably threaded cap (not shown), as desired by a user.

Figure 4:
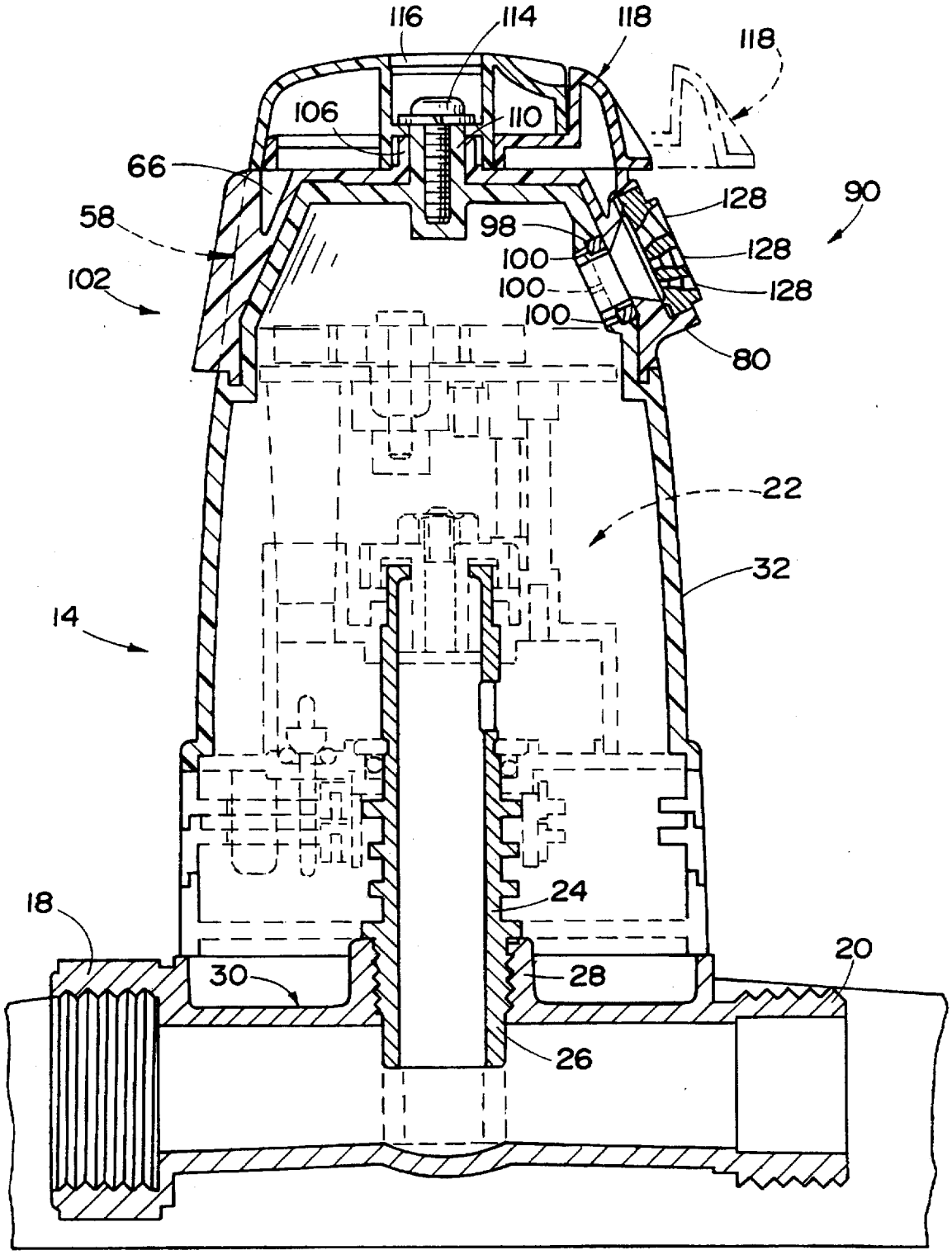
FIG. 4 is a side elevational view, partially in section, of the representative rotary sprinkler embodying the features of the present invention.

As shown in dashed lines in FIG. 4, the rotary sprinkler 10 includes a hydraulic driving means 22 operatively contained within the main housing 14 for rotatably driving the main housing 14 about a vertical axis during operation. Since the driving means 22 is disposed internally of the main housing 14 with no impacting parts, the sprinkler 10 operates quietly when compared to existing pulsating sprinklers. Driving means 22 includes an input tube 24 which is in fluid communication with the water inlet 18. Specifically, a lower portion 26 of the input tube 24 has external threads formed thereon and is engaged with an internally threaded upper portion 28 of a tee 30, which is an integrally formed unit comprising the water inlet 18 and water outlet 20 positioned in the base 12. In operation, the continuous supply of water flows through the tee 30 and input tube 24 into the driving means 22 where it actuates the driving means 22. Once the supply of water has been utilized by the driving means 22, it flows into and is contained in the main housing 14 until it is discharged under pressure from the sprinkler 10 as described more fully below. It should be noted that the driving means 22 may assume a variety of configurations which are well known in the art and not germane to the present invention so long as it is in fluid communication with the continuous supply of water and capable of rotatably driving the main housing 14 during operation. In this regard, while the driving means 22 is shown in one configuration, it is to be considered representative of more sophisticated embodiments. Therefore, further discussion of the driving means 22 is omitted for interest of clarity.

Figure 3:
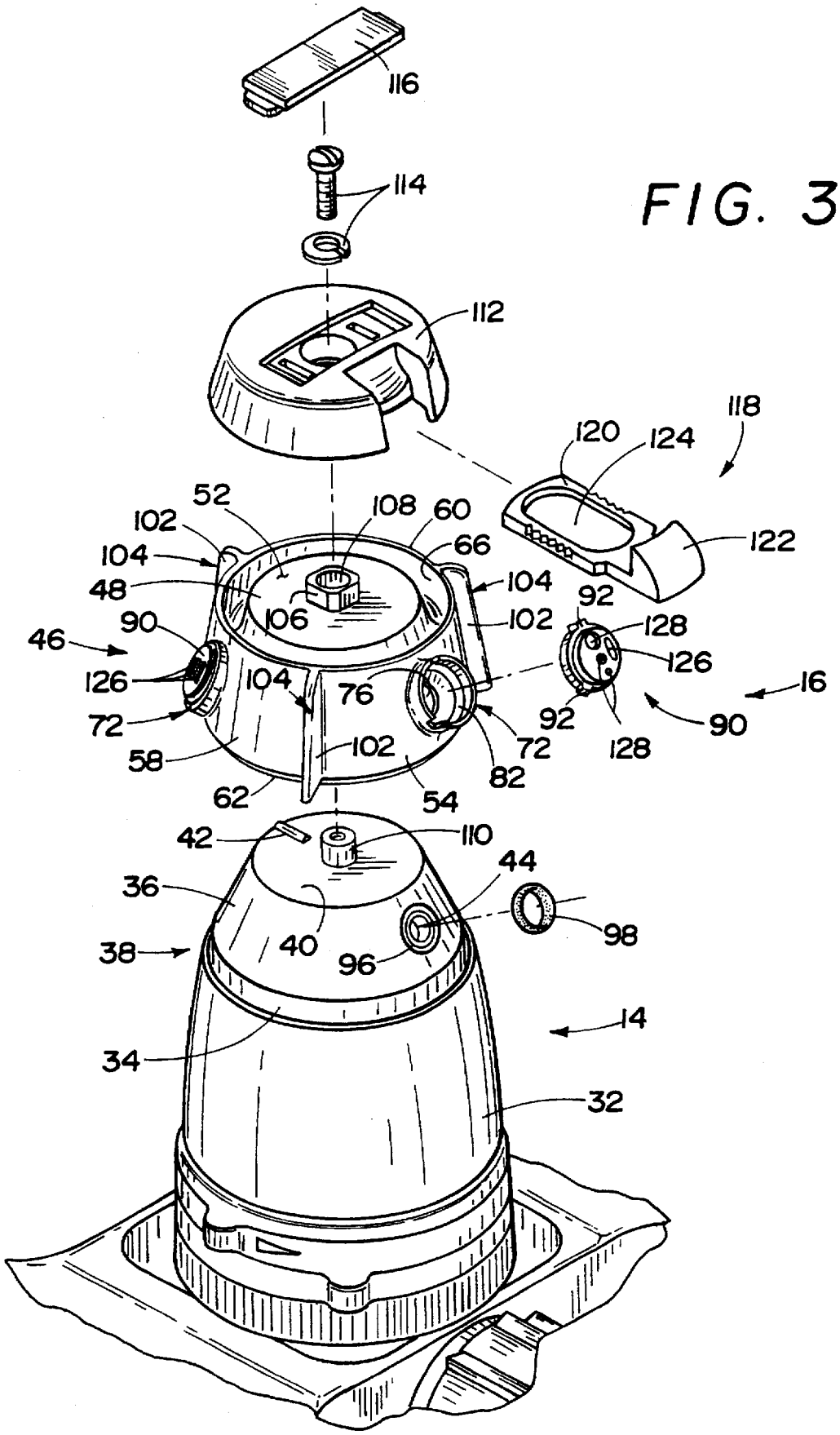
FIG. 3 is a perspective view, partially exploded, of the representative rotary sprinkler embodying the features of the present invention.

Referring to FIGS. 1 and 3–4, the main housing 14 is rotatably mounted on base 12 and operatively engages driving means 22. The main housing 14 is comprised of a lower section 32 having a generally arcuate outer surface; a mid section 34 having a generally cylindrical outer surface; and a tapered upper section 36 tapering radially inwardly wherein mid section 34 and tapered upper section 36 define a turret seat 38. Integrally attached to the tapered upper section 36 is a generally cylindrical top cover 40 which includes a radially extending raised portion 42 positioned in diametrically opposed relation relative a water outlet 44 defined in the tapered upper section 36. During operation of the sprinkler 10, the supply of water is discharged under pressure from the main housing 14 through water outlet 44. As discussed below in greater detail, the raised portion 42 operatively engages the turret assembly 16.

Turret assembly 16 includes a generally hollow turret housing 46 operatively mounted on turret seat 38 for concomitant rotation therewith during operation of the rotary sprinkler 10. The turret housing 46 has a generally disk shaped top 48 with interior 50 and exterior 52 surfaces and a side wall 54 with inner 56 and outer 58 surfaces and upper 60 and lower 62 ends. Outer surface 58 which may taper radially inwardly from the lower end 62 to the upper end 60 defining a frustoconically or truncated cone shaped outer surface 58. In a preferred embodiment, the outer surface 58 is arcuately shaped for continuing the arcuation or arcuate appearance of the generally arcuate outer surface of the lower section 32 of the main housing 14. The lower end 62 of the side wall 54 defines an opening 64. An annular V-shaped groove 66 is formed in the upper end 60 of the side wall 54 which separates the disk shaped top 48 from the outer surface 58. Moreover, the inner surface 56 of the side wall 54 includes an upper tapered inner portion 68 tapering radially inwardly and a lower generally cylindrical inner portion 70. The cylindrical 70 and tapered 68 inner portions are seated on the turret seat 38 defined on the main housing 14 of the sprinkler 10.

Referring to FIGS. 1–8, a plurality of nozzle interface extensions 72 are integrally attached to the outer surface 58 of side wall 54. The extensions 72 extend radially outwardly from the outer surface 58 on an axis 74 generally perpendicular to the tapered inner portion 68 of inner surface 56. Preferably, axis 74 is elevated at an angle of approximately twenty-five degrees relative a horizontally disposed plane. Moreover, the extensions 72 are preferably spaced in equal circumferential relation of approximately one-hundred twenty degrees relative one another on the outer surface 58 of the side wall 54. Side wall 54 includes a plurality of nozzle ports 76 which pass through the tapered inner portion 68 of inner surface 56 for selectively or individually providing fluid communication between one of the plurality of nozzle interface extensions 72 and the water outlet 44 defined in the main housing 14 during operation. The ports 76 are equal in number to the plurality of nozzle interface extensions 72 and are co-axially aligned relative thereto on axis 74.

Structurally, the plurality of nozzle interface extensions 72 are hollow generally cylindrical shells having interior 78 and exterior 80 surfaces. The interior surfaces 78 include an annular ledge 82 disposed relatively perpendicular thereto and a tapered portion 84 for defining a plurality of nozzle seats. In addition, each extension 72 further defines at least one selectively positioned longitudinal slot 86 extending from an end 88 distal the outer surface 58 of the side wall 54 to a position proximal the annular ledge 82. As such, a plurality of nozzles 90, suitable for discharging a spray of water therethrough, are individually seated preferably by ultrasonic welding or solvent bonding on the nozzle seats and each includes at least one finger portion 92 selectively positioned on an outer periphery thereof for corresponding engagement with the selectively positioned longitudinal slot 86 defined on a particular extension 72. The operative engagement of the finger portion 92 and slot 86 determines the rotational orientation of a particular nozzle 90 relative a particular extension 72. In a preferred embodiment, the turret assembly 16 employs three nozzle extensions 72 and three nozzles 90 selectively designed to produce a mist spray, a medium spray, and a large spray of water, respectively. In operation, the rotary sprinkler 10 will produce an area of water coverage ranging from approximately ten to eighty feet in diameter depending on which nozzle 90 is engaged by the user.

As illustrated most clearly in FIG. 6, the interior surface 50 of the top 48 defines a plurality of radially extending grooves 94 positioned in diametrically opposed relation relative the plurality of nozzle ports 76 for selective operative engagement with the radially extending raised portion 42 on the top cover 40 of the main housing 14. Before or during operation of the sprinkler 10, in order to engage a particular nozzle 90, the turret housing 46 is selectively rotated by a user on the main housing 14 such that one of the grooves 94 operatively engages the raised portion 42. This operative engagement rotationally aligns of one of the nozzle ports 76 with the water outlet 44 defined in the main housing 14 which provides fluid communication therebetween during operation of the rotary sprinkler 10. Moreover, the operative engagement further provides concomitant rotation between the turret housing 46 and main housing 14 during operation. Hence, a user will rotate the turret housing 46 to select a particular nozzle 90 to be used, then will provide a supply of water to the sprinkler 10 through a water hose wherein the main housing 14 and turret housing 44 will concomitantly rotate while issuing water therefrom in a particular pattern and distance.

As shown in FIGS. 3 and 4, an annular slot 96 is defined on the outer surface of the tapered upper section 36 of the main housing 14 for retaining an elongated elastomeric seal 98 therein. Preferably, the annular slot 96 is concentrically disposed relative the water outlet 44. A plurality of pressurizing holes 100 are provided through the tapered upper section 36 for providing fluid communication between the annular slot 96 and the supply of water. In operation, the elastomeric seal 98 is urged by the water against the tapered inner portion 68 of inner surface 56 thereby providing a positive fluid seal between the turret housing 46 and the main housing 14. The fluid seal is maintained during operation regardless of the rotational orientation of the turret housing 46 relative the main housing 14. Moreover, it will be readily understood that the elongated cross-section of the elastomeric seal 98, as opposed to a standard O-ring, substantially prevents displacement during rotation of the turret housing 46 relative the main housing 14.

In order to provide a user with a convenient grasping means for selectively rotating the turret housing 46 relative the main housing 14 before and during operation of the sprinkler 10, a plurality of outwardly extending ribs 102 are attached to the outer surface 58 of the side wall 54. In a preferred embodiment, the ribs 102 are positioned in diametrically opposed relation relative the nozzle interface extensions 72 and vertically extend the height of the turret housing 46. Each rib 102 has an outer edge 104 which tapers radially inwardly from the lower end 62 of side wall 54 to the upper end 60.

The exterior surface 52 of the top 48 includes a vertically disposed member 106 having a generally square outer surface concentrically attached thereto for maintaining the vertical alignment of the turret housing 46 with the main housing 14 and for assisting in the securement of the turret housing 46 to the main housing 14. Member 106 defines a hole 108 therethrough which extends through the top 48 for receiving a generally cylindrical extended portion 110 defined on the top cover 40 of the main housing 14 therein. Reception of the extended portion 110 within hole 108 substantially aligns the turret housing 46 and main housing 14 on a common vertical axis. The rotary sprinkler 10 further comprises a housing cover 112 through which a fastener 114, preferably a bolt and washer, secures the housing cover 112 and turret housing 46 to the main housing 14. A name plate 116 is also provided on the top surface of housing cover 112.

As illustrated in FIGS. 1–4, in order to evenly disperse or distribute the spray of water issuing from one of the nozzles 90 (preferably the nozzle 90 designed to produce a large spray of water), the turret assembly 16 further includes a deflector 118. Deflector 118 has a generally elongated flat portion 120 slidingly mounted on the exterior surface 52 of top 48 of the turret housing 46 for sliding movement thereon and an upward extending portion 122 disposed at one end thereof. The deflector 118 is slidably movable between an extended position, shown in FIGS. 1, 2 and 4, and a retracted position, shown in FIG. 4, wherein the extended position exposes the upward extending portion 122 to the spray of water issuing from the selected nozzle 90 thereby deflecting the spray of water. The elongated flat portion 120 further defines an elongated hole 124 therethrough for receiving member 106. Member 106 limits the sliding movement of the deflector 118 to the extended position and the retracted position while its square outer surface insures concomitant rotation between the turret housing 46 and deflector 120 during operation.

It should be noted that the particular design of the nozzles 90 further supplements the prevention of water impact damage to delicate flowers or plants. For instance, each nozzle 90 includes at least one wedge-shaped nozzle exit 126 which produces a fan-shaped spray of water. In operation, this fan-shaped spray of water merges into the jet spray of water issuing from the same nozzle, thus assists in breaking up the concentrated stream of large droplets into small droplets or a mist. As mentioned above, the turret assembly 16 will preferably utilize three nozzles 90 designed to produce a mist spray, a medium spray, and a large spray of water, respectively. A mist spray nozzle 90 includes three wedge-shaped nozzle exits 126, while the medium and large spray nozzles 90 each include one wedge-shaped nozzle exit 126 and a plurality of jet spray nozzle exits 128.

As those skilled in the art will readily understand, operation of the present invention is easily accomplished by attaching a conventional water hose to the water inlet 18, with the water outlet 20 being capped or connected to another conventional water hose. The tee 30, being hollow, provides a passageway through the base 12 for directing the incoming supply of water upwardly through the input tube 24 into the driving means 22 to the water outlet 44. Upon reaching the water outlet 44, the water exits through the water outlet 44 and selected nozzle port 76 and is suitably discharged through the corresponding nozzle 90, with the elastomeric seal 98 preventing any unwanted leakage from the sprinkler 10. It should be noted that, before or during operation, the user will rotate the turret housing 46 on the main housing 14 to select which nozzle 90 to use. Once the supply of water is provided, the operative engagement of one of the grooves 94 and the raised portion 42 will provide concomitant rotation between the turret housing 46 and the main housing 14. Moreover, those skilled in the art will fully appreciate the fact that the present invention may be formed from a number of suitable plastic materials, such as ABS and high impact polystyrene, and may be provided in a wide variety of colors.

While a description of the present invention has been provided in detail, such description is for illustrative purposes only, and it is to be understood that changes and variations may be made without departing from the spirit or scope of the following appended claims.

What is claimed is:

1. A turret assembly for use in a rotary sprinkler having a base and a main housing rotatably mounted on said base, said main housing including a top cover with a radially extending raised portion positioned thereon in diametrically opposed relation with respect to a water outlet defined in said main housing, said turret assembly comprising:

(a) a generally hollow turret housing mounted on said main housing for concomitant rotation therewith during operation of said rotary sprinkler, said turret housing having a top and a side wall with inner and outer surfaces;

(b) a plurality of circumferentially spaced nozzle interface extensions attached to and extending outwardly of said outer surface of said side wall;

(c) a plurality of circumferentially spaced nozzle ports extending through said side wall; and (d) means for circumferentially orienting said turret housing relative to said main housing so as to selectively align one of said nozzle ports with said water outlet and to selectively provide fluid communication between said water outlet and one of said nozzle interface extensions during operation of said rotary sprinkler.

2. A turret assembly as defined in claim 1, wherein said plurality of nozzle ports are equal in number to said plurality of nozzle interface extensions, each of said nozzle ports being coaxially aligned with a corresponding one of said nozzle interface extensions.

3. A turret assembly as defined in claim 1, wherein said said top of said turret housing has an interior surface and said means for circumferentially orienting said turret housing relative to said main housing comprises a plurality of circumferentially spaced and radially extending grooves formed in said interior surface of said top of said turret housing for selective operative engagement with said radially extending raised portion on said top cover of said main housing.

4. A turret assembly as defined in claim 1, wherein said turret housing further includes a plurality of outwardly extending ribs attached to said outer surface of said side wall for allowing a user to easily rotate said turret housing relative said main housing of said rotary sprinkler.

5. A turret assembly as defined in claim 4, wherein said plurality of outwardly extending ribs are equal in number to said plurality of nozzle interface extensions.

6. A turret assembly as defined in claim 5, wherein said plurality of outwardly extending ribs are positioned on said outer surface of said side wall in diametrically opposed relation relative said plurality of nozzle interface extensions.

7. A turret assembly as defined in claim 1 wherein each of said plurality of nozzle interface extensions includes a nozzle seat and said turret assembly further comprises a plurality of nozzles, each of said nozzles being attached to said nozzle seat of one of said nozzle interface extensions, each of said nozzles including at least one nozzle exit effective for discharging water therethrough during the operation of said rotary sprinkler.

8. A turret assembly for use in a rotary sprinkler having a main housing operatively mounted on said sprinkler for rotation thereon, said main housing including a top cover with a radially extending raised portion positioned thereon in diametrically opposed relation with respect to a water outlet defined in said main housing, said turret assembly comprising:

(a) a generally hollow turret housing mounted on said main housing for concomitant rotation therewith during operation of said rotary sprinkler, said turret housing having a top with interior and exterior surfaces and a side wall with inner and outer surfaces and upper and lower ends wherein said inner surface defines a tapered inner portion tapering radially inwardly and a generally cylindrical inner portion said lower end of said side wall defining an opening;

(b) a plurality of nozzle interface extensions attached to said outer surface of said side wall; and (c) a plurality of nozzle ports defined by said side wall for selectively providing fluid communication between one of said plurality of nozzle interface extensions and said water outlet during operation of said rotary sprinkler;

(d) wherein said interior surface of said top defines a plurality of radially extending grooves for selective operative engagement with said radially extending raised portion on said top cover of said main housing, said turret housing selectively rotated on said main housing such that one of said plurality of radially extending grooves operatively engages said radially extended raised portion, said operative engagement rotationally aligning one of said plurality of nozzle ports with said water outlet defined in said main housing for providing fluid communication therebetween during operation of said rotary sprinkler, said operative engagement further providing concomitant rotation between said turret housing and said main housing during operation of said rotary sprinkler.

9. A turret assembly as defined in claim 8, wherein said plurality of radially extending grooves are positioned on said interior surface of said top in diametrically opposed relation relative said plurality of nozzle ports.

10. A turret assembly for use in a rotary sprinkler having a main housing operatively mounted on said sprinkler for rotation thereon, said main housing including a top cover with a radially extending raised portion positioned thereon in diametrically opposed relation with respect to a water outlet defined in said main housing, said turret assembly comprising:

(a) a generally hollow turret housing mounted on said main housing for concomitant rotation therewith during operation of said rotary sprinkler, said turret housing having a top with interior and exterior surfaces and a side wall with inner and outer surfaces and upper and lower ends wherein said inner surface defines a tapered inner portion tapering radially inwardly and a generally cylindrical inner portion, said lower end of said side wall defining an opening;

(b) a plurality of nozzle interface extensions attached to said outer surface of said side wall; and (c) a plurality of nozzle ports defined by said side wall for selectively providing fluid communication between one of said plurality of nozzle interface extensions and said water outlet during operation of said rotary sprinkler; wherein:

(d) said plurality of nozzle interface extensions extend radially outwardly from said outer surface of said side wall on an axis generally perpendicular to said tapered inner portion of said inner surface;

(e) said plurality of nozzle interface extensions comprise hollow generally cylindrical shelves having interior and exterior surfaces, said interior surfaces including an annular ledge and a tapered portion for defining a plurality of nozzle seats.

11. A turret assembly as defined in claim 10, wherein said cylindrical shells are circumferentially spaced in equal relation relative to one another on said outer surface of said side wall.

12. A turret assembly as defined in claim 11, wherein said outer surface of said side wall comprises an arcuately shaped outer surface.

13. A turret assembly as defined in claim 10, wherein each of said cylindrical shells further defines at least one selectively positioned longitudinal slot extending from an end distal said outer surface of said turret housing to a position proximal said annular ledge.

14. A turret assembly as defined in claim 13 further comprising a plurality of nozzles, suitable for discharging a spray of water therethrough, operatively seated on said plurality of nozzle seats, said nozzles each having at least one finger portion selectively positioned on an outer periphery thereof for operative engagement with said selectively positioned slot, said operative engagement determining the rotational orientation of said plurality of nozzles relative said cylindrical shells.

15. A turret assembly as defined in claim 14, wherein said exterior surface of said top includes a vertically disposed member, said member defining a hole therethrough which extends through said top for receiving an extended portion defined on said top cover of said main housing therein.

16. A turret assembly as defined in claim 15, further comprising a deflector for selectively deflecting said spray of water discharged from one of said plurality of nozzles during operation, said deflector having a generally flat portion and an upward extending portion disposed at one end thereof slidingly mounted on said exterior surface of said top for sliding movement thereon, said deflector being slidably movable between an extended position and a retracted position wherein said extended position exposes said upward extending portion to said spray of water thereby deflecting said spray of water.

17. A turret assembly as defined in claim 16, wherein said elongated flat portion of said deflector further defines an elongated hole therethrough for receiving said vertically disposed member of said top, said member limiting said sliding movement of said deflector to said extended position and said retracted position.

18. A turret assembly as defined in claim 17, wherein said vertically disposed member defines a generally square outer surface which engages said elongated hole in said deflector to provide concomitant rotation between said deflector and said turret housing during operation.

19. A turret assembly for use in a rotary sprinkler comprising a main housing operatively mounted on a base for rotation thereon, said main housing having a lower section with a generally arcuate outer surface, a mid section having a generally cylindrical outer surface and a tapered upper section tapering radially inwardly wherein said mid section and said tapered upper section defined a turret seat, said main housing further having a top cover connected to said tapered upper section, said top cover having a radially extending raised portion in diametrically opposed relation to a water outlet defined in said tapered upper section, said turret assembly comprising:

(a) a generally hollow turret housing operatively mounted on said main housing for concomitant rotation therewith during operation of said rotary sprinkler, said turret housing having a top with interior and exterior surfaces and a side wall with inner and outer surfaces and upper and lower ends wherein said inner surface defines an upper tapered inner portion tapering radially inwardly and a lower generally cylindrical inner portion extending below said upper tapered inner portion, said upper tapered inner portion and said lower generally cylindrical inner portion being seated on said turret housing, said lower end of said side wall defining an opening;

(b) a plurality of circumferentially spaced nozzle interface extensions attached to and extending outwardly from said outer surface of said side wall; and (c) means for selectively providing fluid communication between said water outlet and one of said nozzle interface extensions during operation of said rotary sprinkler.

20. A turret assembly as defined in claim 19, wherein said means for selectively providing fluid communication between said water outlet and one of said plurality of nozzle interface extensions comprises:

(a) a plurality of circumferentially spaced nozzle ports extending through said side wall of said turret housing;

(b) means for circumferentially orienting said turret housing relative to said main housing so as to selectively align one of said nozzle ports with said water outlet and to selectively provide fluid communication between said water outlet and said one of said nozzle interface extensions during operation of said rotary sprinkler.

21. A turret assembly as defined in claim 20, wherein said means for circumferentially orienting said turret housing relative to said main housing comprises a plurality of circumferentially spaced and radially extending grooves formed in said interior surface of said top of said turret housing for selective operative engagement with said radially extending raised portion of said top cover of said main housing.

22. A turret assembly for use in a rotary sprinkler comprising a main housing operatively mounted on a base for rotation thereon, said main housing having a lower section with a generally arcuate outer surface, a mid section having a generally cylindrical outer surface and a tapered upper section tapering radially inwardly wherein said mid section and said tapered upper section define a turret seat, said main housing further having a top cover connected to said tapered upper section, said top cover having a radially extending raised portion in diametrically opposed relation to a water outlet defined in said tapered upper section, said turret assembly comprising:

(a) a generally hollow turret housing operatively mounted on said main housing for concomitant rotation therewith during operation of said rotary sprinkler, said turret housing having a top with interior and exterior surfaces and a side wall with inner and outer surfaces and upper and lower ends wherein said inner surface defines a tapered inner portion tapering radially inwardly and a generally cylindrical inner portion, said lower end of said side wall defining an opening;

(b) a plurality of nozzle interface extensions attached to said outer surface of said side wall;

(c) a plurality of nozzle ports defined by said side wall for selectively providing fluid communication between one of said plurality of nozzle interface extensions and said water outlet during operation of said rotary sprinkler, said ports equal in number to said plurality of nozzle interface extensions and concentrically disposed relative thereto; and (d) a plurality of outwardly extending ribs equal in number to said plurality of nozzle interface extensions and attached to said outer surface of said side wall for allowing selective rotation of said turret housing relative to said main housing of said rotary sprinkler; wherein:

(e) said plurality of nozzle interface extensions extend radially outwardly from said outer surface of said side wall on an axis generally perpendicular to said tapered inner portion of said inner surface;

(f) said interior surface of said top further defines a plurality of radially extending grooves positioned in diametrically opposed relation relative to said plurality of nozzle ports for selective operative engagement with said radially extending raised portion on said top cover of said main housing, said turret housing selectively rotated on said main housing such that one of said plurality of radially extending grooves operatively engages said radially extending raised portion, said operative engagement rotationally aligning one of said plurality of nozzle ports with said water outlet defined in said main housing for providing fluid communication therebetween during operation of said rotary sprinkler, said operative engagement further providing concomitant rotation between said turret housing and said main housing during operation of said rotary sprinkler.

23. A turret assembly for use in a rotary sprinkler comprising a main housing operatively mounted on a base for rotation thereon, said main housing having a lower section with a generally arcuate outer surface, a mid section having a generally cylindrical outer surface and a tapered upper section tapering radially inwardly wherein said mid section and said tapered upper section define a turret seat, said main housing further having a top cover connected to said tapered upper section, said top cover having a radially extending raised portion in diametrically opposed relation to a water outlet defined in said tapered upper section, said turret assembly comprising:

(a) a generally hollow turret housing operatively mounted on said main housing for concomitant rotation therewith during operation of said rotary sprinkler, said turret housing having a top with interior and exterior surfaces and a side wall with inner and outer surfaces and upper and lower ends wherein said inner surface defines a tapered inner portion tapering radially inwardly and a generally cylindrical inner portion, said lower end of said side wall defining an opening;

(b) a plurality of nozzle interface extensions attached to said outer surface of said side wall;

(c) a plurality of nozzle ports defined by said side wall for selectively providing fluid communication between one of said plurality of nozzle interface extensions and said water outlet during operation of said rotary sprinkler, said ports equal in number to said plurality of nozzle interface extensions and concentrically disposed relative thereto; and (d) a plurality of outwardly extending ribs equal in number to said plurality of nozzle interface extensions and attached to said outer surface of said side wall for allowing selective rotation of said turret housing relative to said main housing of said rotary sprinkler; wherein:

(e) said plurality of nozzle interface extensions extend radially outwardly from said outer surface of said side wall on an axis generally perpendicular to said tapered inner portion of said inner surface;

(f) said plurality of nozzle interface extensions comprise hollow generally cylindrical shelves having interior and exterior surfaces, said interior surfaces including an annular ledge and a tapered portion for defining a plurality of nozzle seats.

24. A turret assembly as defined in claim 23, wherein said cylindrical shells are equally spaced relative one another on said outer surface of said side wall.

25. A turret assembly as defined in claim 24, wherein said outer surface of said side wall of said turret housing comprises an arcuately shaped outer surface for continuing the arcuation of said arcuate outer surface of said lower section of said main housing of said rotary sprinkler.

26. A turret assembly as defined in claim 23, wherein each of said cylindrical shells further defines at least one selectively positioned longitudinal slot extending from an end distal said outer surface of said turret housing to a position proximal said annular ledge.

27. A turret assembly as defined in claim 26, further comprising a plurality of nozzles, suitable for discharging a spray of water therethrough, operatively seated on said plurality of nozzle seats, said nozzles each having at least one finger portion selectively positioned on an outer periphery thereof for operative engagement with said selectively positioned slot, said operative engagement determining the rotational orientation of said plurality of nozzles relative said cylindrical shells.

28. A turret assembly as defined in claim 27, wherein said top further comprises a vertically disposed member having a generally square outer surface attached to said exterior surface of said top, said member defining a hole therethrough which extends through said top for receiving an extended portion defined on said top cover of said main housing therethrough.

29. A turret assembly as defined in claim 28, further comprising a deflector for selectively deflecting said spray of water discharged from one of said plurality of nozzles, said deflector having a generally flat portion slidingly mounted on said exterior surface of said top for sliding movement thereon and an upward extending portion disposed at one end thereof, said deflector being slidably movable between an extended position and a retracted position wherein said extended position exposes said upward extending portion to said spray of water thereby deflecting said spray of water.

30. A turret assembly as defined in claim 29, wherein said elongated flat portion of said deflector further defines an elongated hole therethrough for receiving said vertically disposed member of said top, said member of said top limiting said sliding movement of said deflector to said extended position and said retracted position and providing concomitant rotation between said turret housing and said deflector during operation.

31. A turret assembly for use in a rotary sprinkler comprising a main housing operatively mounted on a base for rotation thereon, said main housing having a lower section with a generally arcuate outer surface, a mid section having a generally cylindrical outer surface and a tapered upper section tapering radially inwardly wherein said mid section and said tapered upper section define a turret seat, said main housing further having a top cover connected to said tapered upper section, said top cover having a radially extending raised portion in diametrically opposed relation to a water outlet defined in said tapered upper section, said turret assembly comprising:

(a) a generally hollow turret housing operatively mounted on said main housing for concomitant rotation therewith during operation of said rotary sprinkler, said turret housing having a top with interior and exterior surfaces and a side wall with inner and outer surfaces and upper and lower ends wherein said inner surface defines a tapered inner portion tapering radially inwardly and a generally cylindrical inner portion, said lower end of said side wall defining an opening;

(b) a plurality of nozzle interface extensions attached to said outer surface of said side wall;

(c) a plurality of nozzle ports defined by said side wall for selectively providing fluid communication between one of said plurality of nozzle interface extensions and said water outlet during operation of said rotary sprinkler, said ports equal in number to said plurality of nozzle interface extensions and concentrically disposed relative thereto; and (d) a plurality of outwardly extending ribs equal in number to said plurality of nozzle interface extensions and attached to said outer surface of said side wall for allowing selective rotation of said turret housing relative to said main housing of said rotary sprinkler: wherein:

(e) said plurality of nozzle interface extensions extend radially outwardly from said outer surface of said side wall on an axis generally perpendicular to said tapered inner portion of said inner surface;

(f) said plurality of outwardly extending ribs are positioned on said outer surface of said side wall in diametrically opposed relation relative to said plurality of nozzle interface extensions.

32. A turret assembly as defined in claim 31, wherein each of said plurality of outwardly extending ribs has an outer edge tapering radially inwardly from said lower end of said side wall to said upper end.

33. A sprinkler, comprising:

(a) a base having a water inlet for receiving a supply of water;

(b) a main housing, having a water outlet in fluid communication with said supply of water, rotatably mounted on said base;

(c) driving means operatively contained within said main housing and in fluid communication with said supply of water for rotatably driving said main housing;

(d) a generally hollow turret housing, operatively mounted on said main housing for concomitant rotation therewith during operation of said sprinkler, said turret housing having a top with interior and exterior surfaces and a side wall with inner and outer surfaces and upper and lower ends;

(e) a plurality of circumferentially spaced nozzle interface extensions attached to and extending outwardly from said outer surface of said side wall;

(f) a plurality of circumferentially spaced nozzle ports extending through said side wall, said ports being equal in number to said plurality of nozzle interface extensions each of said nozzle ports being coaxially aligned with a corresponding one of said nozzle interface extensions; and (g) means for circumferentially orienting said turret housing relative to said main housing so as to selectively align one of said nozzle ports with said water outlet and to selectively provide fluid communication between said water outlet and the corresponding one of said nozzle interface extensions which is coaxially aligned with said one of said nozzle ports during operation of said rotary sprinkler.

34. A sprinkler as defined in claim 33, wherein:

(a) said main housing comprises:

(i) a lower section having a generally arcuate outer surface;

(ii) a mid section having a generally cylindrical outer surface; and (iii) a tapered upper section tapering radially inwardly, wherein said mid section and said tapered upper section define a turret housing seat for seating said turret housing thereon for concomitant rotation with said main housing;

(b) said inner surface of said turret housing defines an upper tapered inner portion tapering radially inwardly and a lower generally cylindrical inner portion, said upper tapered inner portion and said lower generally cylindrical inner portion being seated on said turret housing seat.

35. A sprinkler as defined in claim 33, wherein:

(a) said main housing further comprises a top cover, attached to said tapered upper section;

(b) said means for circumferentially orienting said turret housing relative to said main housing comprises a radially extending raised portion attached to said top cover and being in diametrically opposed relation to said water outlet;

(c) said water outlet is defined in said tapered upper section of said main housing.

36. A sprinkler as defined in claim 35, wherein said means for circumferentially orienting said turret housing relative to said main housing further comprises a plurality of circumferentially spaced and radially extending grooves formed in said interior surface of said top of said turret housing for selectively operative engagement with said radially extending raised portion attached to said top cover of said main housing.

37. A sprinkler as defined in claim 33, wherein said plurality of nozzle interface extensions extend radially outwardly from said outer surface of said side wall, each of said extensions having an axis which is generally perpendicular to said upper tapered inner portion of said inner surface and is elevated relative to a horizontally disposed plane.

38. A sprinkler comprising:

(a) a base having a water inlet for receiving a supply of water;

(b) a main housing, having a water outlet in fluid communication with said supply of water, rotatably mounted on said base;

(c) driving means operatively contained within said main housing and in fluid communication with said supply of water for rotatably driving said main housing;

(d) a generally hollow turret housing, operatively mounted on said main housing for concomitant rotation therewith during operation of said sprinkler, said turret housing having a top with interior and exterior surfaces and a side wall with inner and outer surfaces and upper and lower ends wherein said inner surface defines a tapered inner portion tapering radially inwardly and a generally cylindrical inner portion, said lower end of said side wall defining an opening;

(e) a plurality of nozzle interface extensions attached to said outer surface of said side wall;

(f) a plurality of nozzle ports defined by said side wall for selectively providing fluid communication between one of said plurality of nozzle interface extensions and said water outlet during operation of said sprinkler, said ports equal in number to said plurality of nozzle interface extensions and concentrically disposed relative thereto; and (g) a plurality of outwardly extending ribs equal in number to said plurality of nozzle interface extensions and attached to said outer surface of said side wall for allowing a user to selectively rotate said turret housing relative to said main housing of said sprinkler;

(h) wherein said main housing comprises:

a lower section having a generally arcuate outer surface:

a mid section having a generally cylindrical outer surface:

a tapered upper section tapering radially inwardly wherein said mid section and said tapered upper section define a turret housing seat for rotatably seating said turret housing thereon; and a top cover, attached to said tapered upper section, having a radially extending raised portion in diametrically opposed relation to said water outlet, said water outlet defined in said tapered upper section of said main housing;

(i) wherein said plurality of nozzle interface extensions extend radially outwardly from said outer surface of said side wall on an axis generally perpendicular to said tapered inner portion of said inner surface; and (j) wherein said interior surface of said top further defines a plurality of radially extending grooves positioned in diametrically opposed relation relative to said plurality of nozzle ports for selective operative engagement with said radially extending raised portion on said top cover of said main housing of said rotary sprinkler, said turret housing selectively rotated by a user on said main housing such that one of said plurality of radially extending grooves operatively engages said radially extending raised portion, said operative engagement rotationally aligning one of said plurality of nozzle ports with said water outlet defined in said main housing for providing fluid communication therebetween during operation of said rotary sprinkler, said operative engagement further providing concomitant rotation between said turret housing and said main housing during operation of said rotary sprinkler.

39. A sprinkler as defined in claim 38, wherein said plurality of nozzle interface extensions are hollow generally cylindrical shells having interior and exterior surfaces, said interior surfaces including an annular ledge and a tapered portion for defining a plurality of nozzle seats.

40. A sprinkler as defined in claim 39, wherein said cylindrical shells are equally spaced relative one another on said outer surface of said side wall of said turret housing.

41. A sprinkler as defined in claim 40, wherein said outer surface of said side wall of said turret housing comprises an arcuately shaped outer surface for continuing the arcuation of said arcuate outer surface of said lower section of said main housing of said rotary sprinkler.

42. A sprinkler as defined in claim 39, wherein each of said cylindrical shells further defines at least one selectively positioned longitudinal slot extending from an end distal said outer surface of said turret housing to a position proximal said annular ledge.

43. A sprinkler as defined in claim 42, further comprising a plurality of nozzles, suitable for discharging a spray of water therethrough, operatively seated on said plurality of nozzle seats, said nozzles each having at least one finger portion selectively positioned on an outer periphery thereof for operative engagement with said selectively positioned slot, said operative engagement determining the rotational orientation of said plurality of nozzles relative said cylindrical shells.

44. A sprinkler as defined in claim 43, wherein said plurality of outwardly extending ribs are positioned on said outer surface of said side wall in diametrically opposed relation relative said cylindrical shells.

45. A sprinkler as defined in claim 44, wherein each of said plurality of outwardly extending ribs has an outer edge tapering radially inwardly from said lower end of said side wall of said turret housing to said upper end of said side wall.

46. A sprinkler as defined in claim 43, wherein said top further comprises a vertically disposed member having a generally square outer surface attached to said exterior surface of said top, said member defining a hole therethrough which extends through said top for receiving an extended portion defined on said top cover of said main housing of said rotary sprinkler therethrough.

47. A sprinkler as defined in claim 46, further comprising a deflector for selectively deflecting said spray of water discharged from one of said plurality of nozzles, said deflector having a generally flat portion slidingly mounted on said exterior surface of said top for sliding movement thereon and an upward extending portion disposed at one end thereof, said deflector being slidably movable between an extended position and a retracted position wherein said extended position exposes said upward extending portion to said spray of water thereby deflecting said spray of water.

48. A sprinkler as defined in claim 47, wherein said elongated flat portion of said deflector further defines an elongated hole therethrough for receiving said vertically disposed member of said top, said member of said top limiting said sliding movement of said deflector to said extended position and said retracted position.

49. A sprinkler as defined in claim 38, wherein said tapered upper section of said main housing further defines an annular slot on an outer surface thereof for receiving an elastomeric seal therein, said annular slot concentrically disposed relative said water outlet.

50. A sprinkler as defined in claim 49, wherein said tapered upper section of said main housing further defines a plurality of holes in communication with said annular slot for providing fluid communication between said annular slot and said supply of water wherein said supply of water sealingly urges said elastomeric seal against said tapered inner portion of said inner surface of said side wall thereby providing a fluid seal.

* * * * *